US009410731B1

(12) United States Patent
Rowland

(10) Patent No.: US 9,410,731 B1
(45) Date of Patent: Aug. 9, 2016

(54) EXPANDABLE DRAIN PAN

(71) Applicant: J.F.R. Enterprises, Inc., Johns Creek, GA (US)

(72) Inventor: Jay F. Rowland, Johns Creek, GA (US)

(73) Assignee: J.F.R. ENTERPRISES, INC., Johns Creek, GA (US)

( * ) Notice: Subject to any disclaimer, the term of this patent is extended or adjusted under 35 U.S.C. 154(b) by 0 days.

(21) Appl. No.: 14/493,176

(22) Filed: Sep. 22, 2014

Related U.S. Application Data

(63) Continuation-in-part of application No. 13/542,866, filed on Jul. 6, 2012, now Pat. No. 9,080,786.

(60) Provisional application No. 61/504,767, filed on Jul. 6, 2011.

(51) Int. Cl.

| | |
|---|---|
| ***F25D 21/14*** | (2006.01) |
| ***F24F 13/22*** | (2006.01) |
| ***F28F 17/00*** | (2006.01) |
| ***B65D 21/08*** | (2006.01) |
| ***B65D 1/40*** | (2006.01) |

(52) U.S. Cl.
CPC *F25D 21/14* (2013.01); *B65D 1/40* (2013.01); *B65D 21/086* (2013.01); *F24F 13/222* (2013.01); *F28F 17/005* (2013.01); *Y10T 137/5762* (2015.04)

(58) Field of Classification Search
USPC ..... 137/312–314; 62/285, 291; 220/571; 222/108; 141/86; 184/106; 296/38; 52/169.3, 169.5–169.7, 198, 209, 52/302.1, 302.3
See application file for complete search history.

(56) References Cited

U.S. PATENT DOCUMENTS

| | | | | |
|---|---|---|---|---|
| D32,575 | S | 4/1900 | Stevenson | |
| 872,837 | A * | 12/1907 | Mio | A21B 3/13 220/8 |
| 1,487,065 | A | 3/1924 | Irons | |
| 1,584,175 | A | 5/1926 | Irons | |
| 1,915,849 | A | 6/1933 | Crimmel | |
| 2,934,003 | A | 4/1960 | Ladymon | |
| 3,224,216 | A | 12/1965 | Crouch | |
| 3,318,107 | A | 5/1967 | Riley | |
| 3,367,132 | A | 2/1968 | Elliott | |
| 3,480,178 | A | 11/1969 | Morgan | |

(Continued)

FOREIGN PATENT DOCUMENTS

| | | |
|---|---|---|
| DE | 2650288 | 5/1978 |
| EP | WO0039512 | 7/2000 |
| KR | 200402748 | 3/2004 |

*Primary Examiner* — Kevin Murphy
*Assistant Examiner* — Jonathan Waddy
(74) *Attorney, Agent, or Firm* — Eric W. Cernyar

(57) ABSTRACT

An expandable secondary condensate drain pan comprises a drainage basin formed by sidewalls that extend upwardly around a perimeter of the drain pan from a base. An expansion section allows portions of the base and sidewalls to be expanded or compressed. When located along a side of the drain pan, the base of the expansion section may be stepped such that the base at the side of the pan is higher than the base toward the center of the pan, allowing drainage to cascade away from the side of the pan. The expansion section may be strengthened against cracking by a relatively thin coating or film. A method for installing a pre-manufactured expandable secondary condensate drain pan under an air conditioning unit comprises adjusting the size of the drain pan, placing the drain pan on a support, and setting an air conditioning unit on the drain pan.

20 Claims, 15 Drawing Sheets

(56) References Cited

U.S. PATENT DOCUMENTS

| | | | | |
|---|---|---|---|---|
| 3,724,233 | A | 4/1973 | Pugh et al. | |
| 3,788,581 | A | 1/1974 | Rutzick | |
| 3,790,115 | A | 2/1974 | Fox | |
| 3,834,527 | A * | 9/1974 | Howe | 206/494 |
| 3,848,546 | A | 11/1974 | Lawlor | |
| 3,888,090 | A | 6/1975 | Meyer | |
| 4,243,197 | A | 1/1981 | Wright | |
| D262,104 | S | 12/1981 | Simpson | |
| D271,328 | S | 11/1983 | Lanier et al. | |
| 4,480,748 | A | 11/1984 | Wind | |
| 4,484,661 | A | 11/1984 | Evenson | |
| 4,604,874 | A | 8/1986 | Seeley | |
| 4,644,753 | A | 2/1987 | Burke | |
| 4,653,651 | A | 3/1987 | Flum | |
| 4,687,604 | A | 8/1987 | Goettl | |
| 4,733,790 | A | 3/1988 | Stein | |
| 4,783,971 | A | 11/1988 | Alba | |
| 4,814,752 | A | 3/1989 | Lehman | |
| 4,835,984 | A | 6/1989 | Vyavaharkar | |
| 4,869,456 | A | 9/1989 | Jacobs | |
| 4,917,581 | A | 4/1990 | Richardson | |
| D308,247 | S | 5/1990 | Adam | |
| 4,930,632 | A | 6/1990 | Eckert | |
| D309,571 | S | 7/1990 | Lehman | |
| 5,076,534 | A | 12/1991 | Adam | |
| 5,147,039 | A | 9/1992 | Sechler | |
| 5,224,508 | A | 7/1993 | Bates | |
| 5,230,601 | A | 7/1993 | Apps et al. | |
| 5,249,699 | A | 10/1993 | Williams | |
| 5,307,931 | A | 5/1994 | Gillispie | |
| 5,316,386 | A * | 5/1994 | Moore | 383/10 |
| D353,665 | S | 12/1994 | Jennings | |
| 5,392,944 | A | 2/1995 | Jennings | |
| 5,429,236 | A | 7/1995 | Evans | |
| 5,511,386 | A | 4/1996 | Russ | |
| 5,664,430 | A * | 9/1997 | Karman | 62/285 |
| 5,848,536 | A | 12/1998 | Dodge | |
| 5,881,566 | A | 3/1999 | Shacklock | |
| 5,901,566 | A * | 5/1999 | Macosko | F24F 13/22 62/285 |
| 5,904,053 | A | 5/1999 | Polk | |
| 5,961,093 | A | 10/1999 | Jones | |
| 6,065,531 | A | 5/2000 | Schneider | |
| 6,112,536 | A | 9/2000 | Hansen | |
| 6,125,647 | A | 10/2000 | Martinez | |
| 6,286,328 | B1 | 9/2001 | Kawahara | |
| 6,360,911 | B1 | 3/2002 | Arnold | |
| 6,382,108 | B1 | 5/2002 | Stanek | |
| D485,283 | S | 1/2004 | Shuck | |
| 6,718,788 | B1 | 4/2004 | Shuck | |
| 6,766,615 | B2 | 7/2004 | Smead | |
| 6,797,894 | B2 | 9/2004 | Montagnino et al. | |
| 6,868,689 | B1 | 3/2005 | McNeil et al. | |
| 6,895,770 | B1 * | 5/2005 | Kaminski | 62/285 |
| 6,978,909 | B2 | 12/2005 | Goetzinger | |
| D562,963 | S | 2/2008 | Cantolino | |
| 7,637,387 | B1 | 12/2009 | Cantolino | |
| D608,917 | S | 1/2010 | Ward et al. | |
| 7,673,646 | B1 | 3/2010 | Cantolino | |
| 7,878,019 | B2 | 2/2011 | Cantolino | |
| 7,891,635 | B2 | 2/2011 | Rowland | |
| 7,900,795 | B1 | 3/2011 | Cantolino | |
| 8,100,140 | B1 | 1/2012 | Cantolino | |
| 8,122,733 | B2 | 2/2012 | Raab | |
| 8,136,782 | B2 | 3/2012 | Rowland | |
| 8,152,129 | B2 | 4/2012 | Hermans | |
| 8,220,768 | B1 | 7/2012 | Cantolino | |
| 2002/0000093 | A1 | 1/2002 | Lea | |
| 2002/0023293 | A1 * | 2/2002 | Lewis | 4/251.1 |
| 2006/0144071 | A1 | 7/2006 | Rowland | |
| 2006/0266754 | A1 * | 11/2006 | Carmona | B65D 21/086 220/666 |
| 2007/0017921 | A1 * | 1/2007 | Carmona | B65D 21/086 220/666 |
| 2008/0245802 | A1 * | 10/2008 | Gray | F24F 13/222 220/571 |
| 2010/0018980 | A1 | 1/2010 | Oakner | |
| 2011/0088423 | A1 | 4/2011 | Ieardi | |

* cited by examiner

EXPANDABLE DRAIN PAN

RELATED APPLICATIONS

This application is a continuation-in-part of my U.S. patent application Ser. No. 13/542,866, filed Jul. 6, 2012, entitled "Drop-front Drain Pan," which in turn claims priority to my U.S. provisional patent application Ser. No. 61/504,767, filed Jul. 6, 2011, entitled "Drop-front Drain Pan," the latter of which is referred to herein as "the provisional application." Both related applications are herein incorporated by reference.

FIELD OF THE INVENTION

This invention relates to drain pans for air handling units, and more particularly, to secondary or overflow drain pans for forced air conditioning systems.

BACKGROUND OF THE INVENTION

As air passes over the evaporator coil inside an air handler, such as one used with a split air conditioning or heat pump system, condensate forms on the coil. This condensate descends from the coil into the primary drain pan inside the air handler. In case the primary pan overflows, contractors often install a secondary, or emergency, drain pan under the air handler.

A secondary drain pan is typically made of plastic or metal and is rectangular or round in shape. Common pan sizes range from 18"×46" to 36"×60" to 34"×79". Such a pan typically has side walls that define a basin that contains a waterway that allows drainage to exit through a drainage hole. The secondary pan rests on a platform or hangs under suspended equipment.

Secondary drain pans should be maneuverable enough to fit through attic or crawlspace doors. For cost, handling, and code considerations, plastic pans are generally made from a minimum 0.065" thick material, and sturdier pans may be 0.125" thick, or more. Sheet metal pans generally have a minimum thickness of 0.0236" (24 gage).

A variety of methods and materials, some referred to as risers, are employed in the field in order to elevate the installed equipment above the level of any water that may collect in the pan. Equipment may be elevated further to provide proper drainage pitch for the primary drain line and easy access to equipment panels. This elevation is achieved by using substantial risers, by constructing a platform under the drain pan, or by hanging the unit from the ceiling trusses. As discussed in my patent application Ser. No. 11/320,992, filed Dec. 29, 2005, one improvement to the art is a drain pan with integrated risers that provide structural support for the air handler. When formed of plastic, that pan requires thicker material than ordinary pans in order to meet structural requirements and to withstand potentially high attic temperatures (140° F.). Yet the pan still must be set on a plywood platform for support. Distributors and contractors must purchase and carry a variety of pan types and sizes in order to meet the needs of different installations. There is a need in the art for a drain pan that is adjustable to fit a range of equipment sizes and installation configurations.

SUMMARY

An expandable secondary condensate drain pan is provided to capture any condensate that overflows from a primary drain pan of an air handling unit mounted above the drain pan. The drain pan, which may be thermoformed and unibody, comprises a drainage basin formed by sidewalls that extend upwardly around a perimeter of the drain pan from a base. An expansion section, which allows a section of the base and corresponding sections of the sidewalls to be expanded or compressed, may be located toward the middle of the pan or along a side of the pan. When located along a side of the drain pan, the base of the expansion section may be stepped such that the base at the side of the pan is higher than the base toward the center of the pan. A stepped base allows drainage to cascade toward the center of the pan and away from the side of the pan. The expansion section may be flexible or convertible and operative to configure the drain pan between commonly used drain pan sizes, permitting a contractor to carry only one drain pan that may function in multiple common pan sizes.

The expansion section may be configured to expand and collapse along a plurality of fold lines and may be further configured to minimize pooling of drainage through a variety of means. The expansion section may be strengthened against cracking by a relatively thin coating or film. Further, the secondary pan may contain risers and may be nestably stackable.

A method is also provided for installing a pre-manufactured expandable secondary condensate drain pan under an air conditioning unit comprises adjusting the size of the drain pan, placing the drain pan on a support, and setting an air conditioning unit on the drain pan. The method may further comprise placing anti-vibration pads or risers in the pan under the air conditioning unit.

These and many other embodiments and advantages of the invention will be readily apparent to those skilled in the art from the following detailed description taken in conjunction with the annexed sheets of drawings, which illustrate the invention.

BRIEF DESCRIPTION OF THE DRAWINGS

It will be appreciated that the drawings are provided for illustrative purposes and that the invention is not limited to the illustrated embodiment. For clarity and in order to emphasize certain features, not all of the drawings depict all of the features that might be included with the depicted embodiment. The invention also encompasses embodiments that combine features illustrated in multiple different drawings; embodiments that omit, modify, or replace some of the features depicted; and embodiments that include features not illustrated in the drawings. Therefore, it should be understood that there is no restrictive one-to-one correspondence between any given embodiment of the invention and any of the drawings.

Also, many modifications may be made to adapt or modify a depicted embodiment without departing from the objective, spirit and scope of the present invention. Therefore, it should be understood that, unless otherwise specified, this invention is not to be limited to the specific details shown and described herein, and all such modifications are intended to be within the scope of the claims made herein.

DETAILED DESCRIPTION OF THE INVENTION

Figure 1:
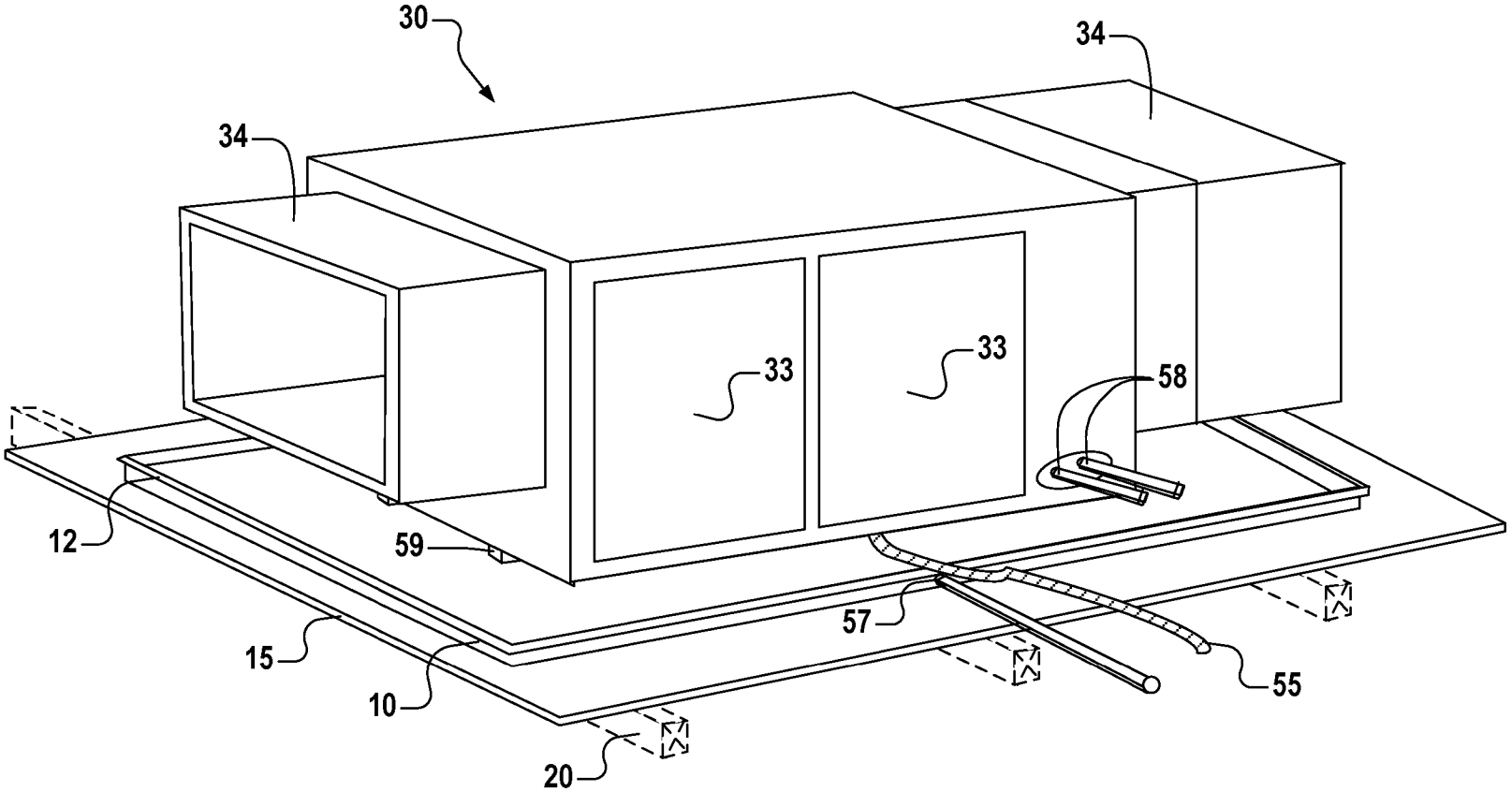
Fig. 1 Prior Art
FIG. 1 is a perspective view of a typical prior art horizontal air handler installation.

FIG. 1 illustrates a standard prior art secondary drain pan 10 mounted with and under a horizontal air handling unit 30 inside an attic. A sheet of plywood 15 placed on the framing joists or truss chords 20 forms a platform for the installation and provides a working area for the technician. The drain pan 10 is placed under the unit 30 in order to capture any leakage. Inside the unit 30 is a primary drain pan (not shown) that is equipped with one or more drainage outlets 58. The secondary drain pan 10 is also equipped with one or more drainage outlets 57. The unit 30 also may be equipped with p-traps (not shown) and condensate shut-off switches (not shown). Standard pans 10 typically have sides of 1.5" to 3" in height, with a small lip 12 around the upper perimeter, and substantially flat bottoms. The pan 10 may contain profiles (not shown) to add rigidity and yet allow drainage to reach the drainage outlet 57.

Units 30 are usually placed on anti-vibration pads or tall risers 59 to elevate the unit 30 out of any water in the pan 10. Elevation also helps with access to the unit 30 and removal of panels 33. In addition, units are typically elevated further to provide proper drain line pitch. This elevation may be achieved through additional risers (not shown) or by elevating the entire platform 15 under the pan 10. Newer drain pans 10 have integral risers to save contractors time and material. Upflow installations also use pans 10, but with a smaller footprint. Alternatively, both the unit 30 and the secondary drain pan 10 may be hung from attic rafters or other framing (not shown). Drain pans 30 are either hung under the unit, not bearing the weight of the unit 30, or are placed on a suspended platform. Metal pans may be favored when hanging, as they flex less. In all instances, the drain pan 10 remains stationary, held in place by supports, equipment, and completed ductwork 34.

Figure 2:
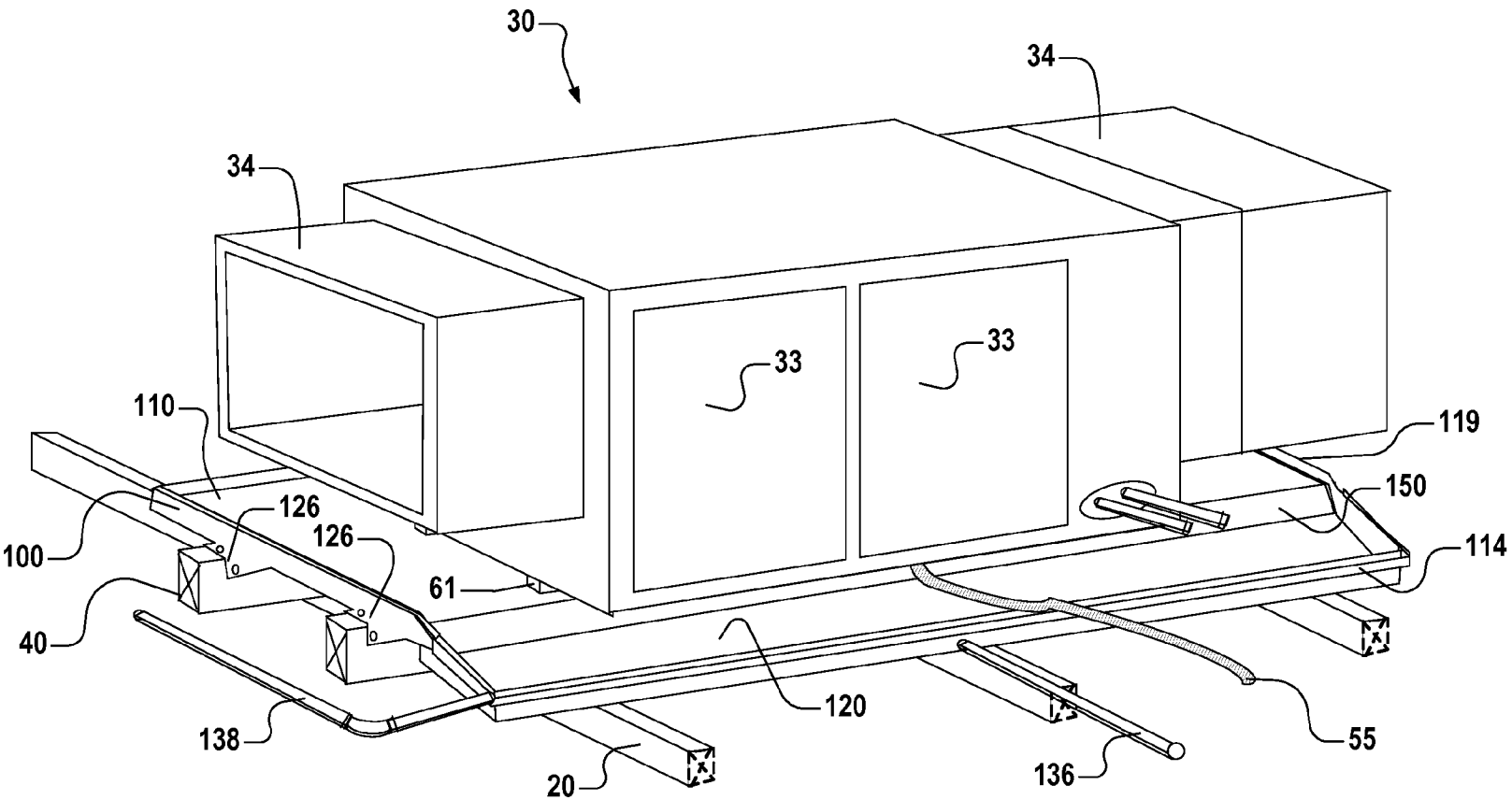
FIG. 2 is a perspective view of a horizontal air handler installation using an embodiment of a new drop-front drain pan.

FIG. 2 depicts an installation similar to that shown in FIG. 1, but incorporates an embodiment of a novel and nestably-stackable secondary condensate drop-front drain pan 100 configured to capture any condensate that overflows from a primary drain pan of an air conditioning unit 30 that is mounted above the drain pan 100. The drain pan 100 is, in one embodiment, thermoformed and unibody and, in another embodiment, made from sheet metal. The drain pan 100 comprises a drainage basin formed by a main or upper base or basin portion 110, an auxiliary lower base, basin, or trough portion 120, and sidewalls 119 that extend upwardly around a perimeter of the drain pan from both the upper base and trough portions 110 and 120. The trough portion 120 is located along only one side (e.g., a front side corresponding with the panels 33 of the unit 30, where a technician could most easily access it) of the drain pan 100. The trough portion 120 is also stepped down relative to the main base portion 110, vertically displaced from it by an at least steeply sloping or alternatively vertical transition section 150. When the upper base portion 110 is positioned upon support beams 40, the trough portion 120 descends along or near a side or end of the front support beam 40 and below a portion of the front support beam 40.

The drop-front drain pan 100 is adapted to be fitted over and take its structural support from elevating elongated support beams 40. Downwardly extending projections or lugs descending below the plane of the drainage basin form notches or saddles 126 for straddling or mounting the drain pan to the support beams 40. In this instance, 2" lumber of any desired height is placed on top of and attached to attic truss chords or other structural framing joists 20. Specifically, FIG. 2 depicts a 30"×60" drain pan 100 placed on top of elongated support beams 40 made of 2" lumber, with the pan 100 supported by and attached to the 2" lumber through saddles or notches 126 formed on the sides of the pan 100. The combination of 2" lumber plus drain pan 100 is used in place of a plywood platform 15, saving labor and material cost. Contractors may install longer pieces 40 of 2" lumber in order to distribute the load of the unit 30 across more truss chords 20. Attic insulation may be placed under the elevated drain pan 100. The air handling or air conditioning unit 30, with ductwork 34 attached, sits on top of anti-vibration pads 61, which in turn sit on the drain pan 100. The supports 40 and risers 61 do not interfere with condensate running to the front trough portion 120.

The upper base portion 110 of the drain pan 100 may be shallower than standard pans 10, with a sidewall height of about 1"-1.5", because the upper area routes water to the trough portion 120 and does not hold water. The short sidewall height, along with the elevation provided by the 2" lumber, allows for the use of short risers 61 under the unit 30. The unit 30 has sufficient drain line pitch. Even with short risers 61, the drop-front pan 100 allows access for the technician to open panels 33 and to connect a flexible gas pipe 55 under the unit 30 if needed. The drop-front trough portion 120 may have a primary or main drainage outlet 136 at its lower edge, and the sides of the trough portion 120 may be 1.5"-3" high in order to meet code. The front trough portion 120 also serves as a lightweight tool rest for the technician.

As illustrated in FIGS. 3-7, a transitional section 150 of the pan 100 that transitions from upper base portion 110 to the auxiliary base or trough portion 120 may be gusseted on the sides to enable the pan 100 to lie flat. Contractors in the field will appreciate a pan 100 with a convertible transition portion 150 that can convert the pan 100 from a standard or conventional substantially flat configuration 176 (FIG. 6) to a stepped drop-front configuration 174 (FIG. 7) that aids elevated installations. The expandable and/or bendable properties of the gussets 160 at key points or fold lines allow the pan 100 to transform between a drop-front or stepped configuration 174 and a standard or substantially flat pan configuration 176. Drainage channels (not shown) may run across the transition section or fold area 150, so that water may still drain when the pan 100 is in a standard, substantially flat configuration. Or, the channels of the gussets 160 may be much shallower than illustrated. Similarly, in FIGS. 25-30 the expansion section 150 allows an expandable drain pan 100 to transform from one size of "flat" drain pan to another size of "flat" drain pan.

Figure 8:
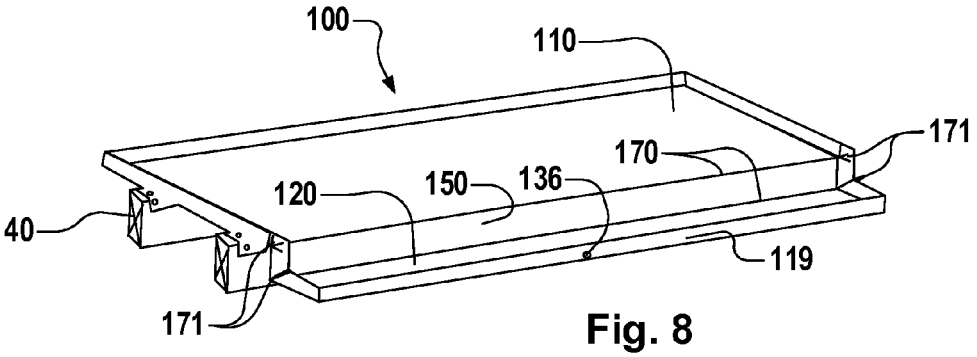
FIG. 8 is a perspective view of a convertible drop-front drain pan that employs living hinges to enable modification between stepped and standard configurations.

Alternatively, as illustrated in FIG. 8, the pan 100 may bend along a line, such as a living hinge 170 or other discrete fold, or may bend over a wider portion of material, as in the case of corrugated material. It also is envisioned that the pan 100 may fold in ways and locations other than those illustrated.

Figure 3:
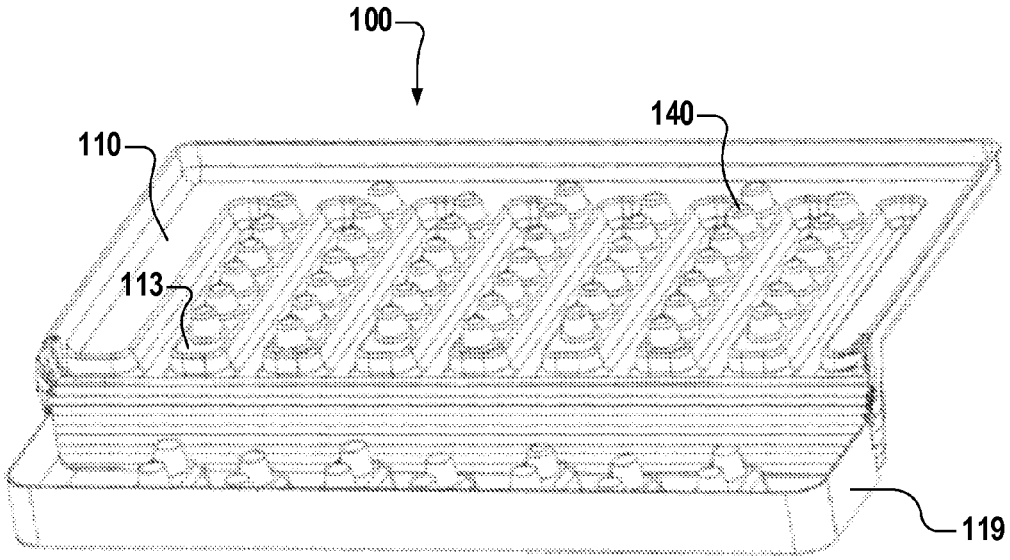
FIG. 3 is a perspective view of a convertible drop-front drain pan in a stepped configuration.
Figure 7:
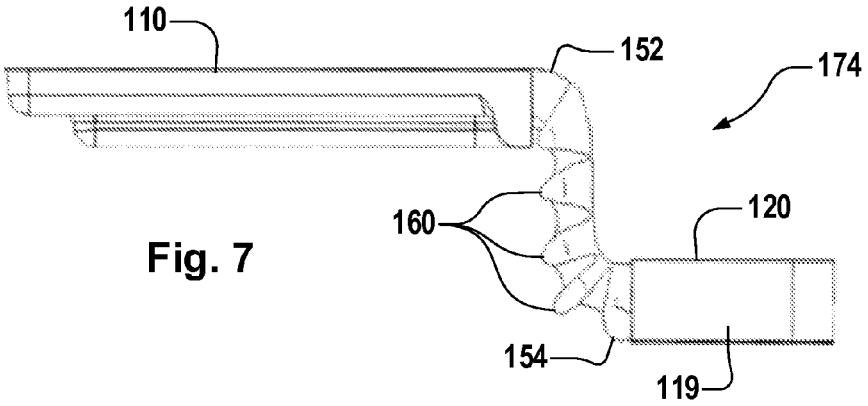
FIG. 7 is a side view of the convertible drop-front drain pan of FIG. 3 in a stepped configuration.

The pan 100, in the stepped configuration 174, as illustrated in FIGS. 3, 7, and 8, may be used on top of a suspension frame or on 2"×8" lumber for elevation. The sidewalls 119 are approximately 2" high. As best illustrated in FIG. 7, at the top bend 152, the gussets 160 are expanded to allow the downward bend of the trough portion 120, while maintaining leak-free continuity in the sidewalls 119 between the main base section 110 and the trough or front base section 120. At the bottom bend 154 of the trough portion 120, where the trough portion 120 begins to extend forward, the gussets 160 are compressed to hold the trough portion 120 in its roughly horizontal position. The gussets 160 may be secured to maintain the pan 100 in this position. The top of the transition portion 150 may have no upper lip in order to allow flexibility.

Further, the trough portion 120 may be secured to framing joists 20 or support beams 40 to maintain the stepped configuration 174 and anchor the drain pan 100 to its support. Typically, however, the drop-front drain pan 100 will not be installed directly on the truss chords or framing joists 20. Generally, elevating support beams 40 are contemplated to achieve a proper installation.

Figure 4:
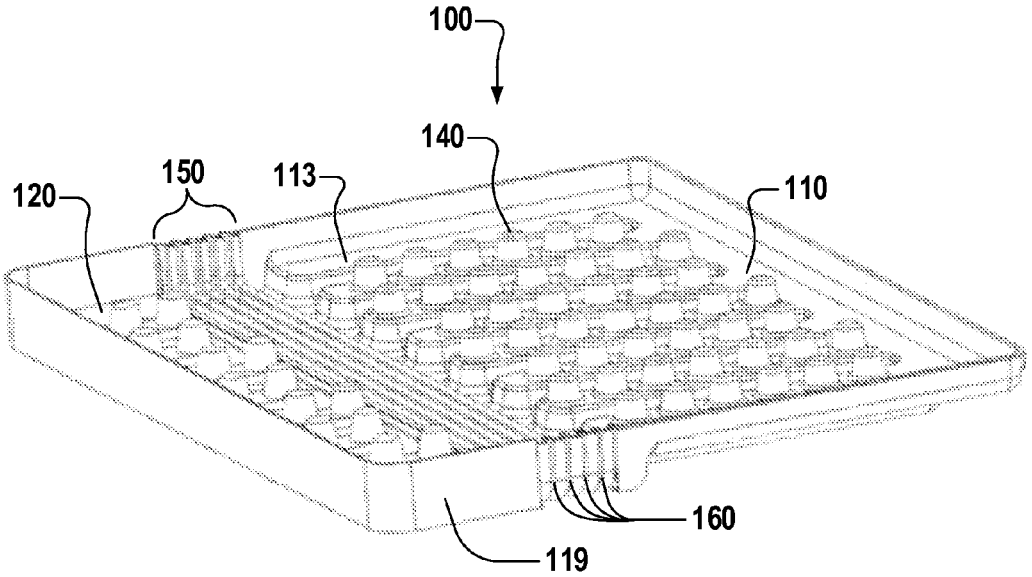
FIG. 4 is a perspective view of the convertible drop-front drain pan of FIG. 3 in a standard or substantially flat configuration.
Figure 5:
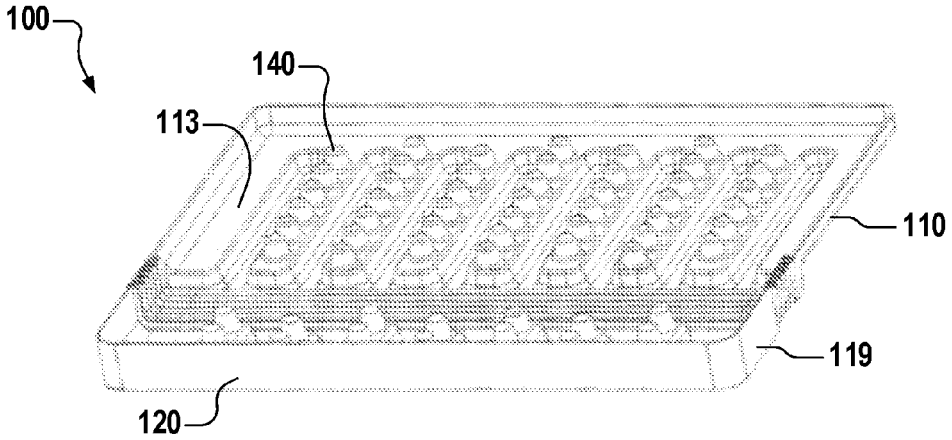
FIG. 5 is another perspective view of the convertible drop-front drain pan of FIG. 3, also in a standard configuration.
Figure 6:
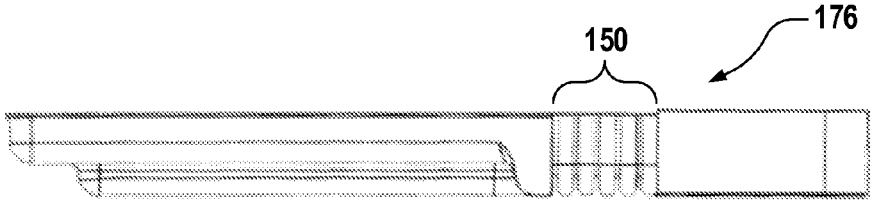
FIG. 6 is a side view of the convertible drop-front drain pan of FIG. 3 in a standard configuration.
Figure 13:
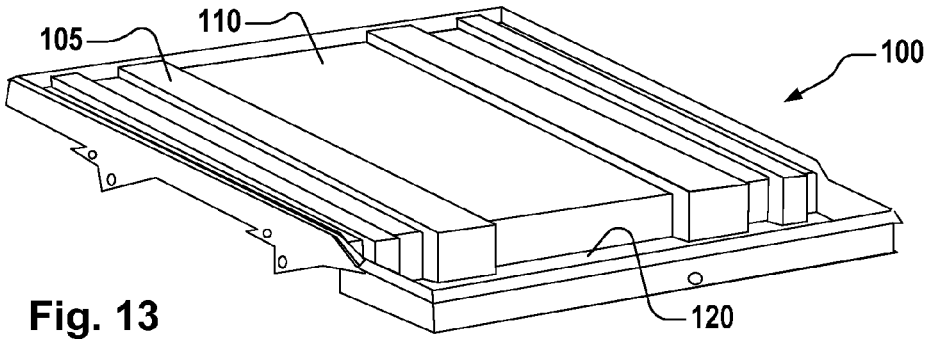
FIG. 13 is a perspective view of a drop-front drain pan with channels for front-to-back support beams.

Support beams 40 may run left to right under the entire drain pan 100, as shown in many of the drawings, or front to back within risers 113, as shown in FIGS. 3-5, and within corresponding underside channels 105 as shown in FIG. 13. Also, as shown in FIGS. 3-5, for example, cones or other molded risers 140 may elevate the unit 30 and transfer the load to the supports 40, or anti-vibration pads (not shown) or other materials may be used in place of the cones 140. The cones 140 may be further constructed to enable screws to run through the cones 140 and into the supports 40 without allowing condensate to escape through the cones (not shown). Certain cones 140 may also be reinforced with foam or other material to make them stronger.

As depicted in FIG. 7, the front "drop" is about 5", and the trough portion 120 is about 5" from front to back. The height and depth of the trough portion 120 are modifiable, of course, and when modified will change the overall dimensions of the drop-front and flat modes of the pan 100, as well as the difference in dimension between those two modes. A first drain hole 136 (FIG. 10) may be placed front and center, or at another location as needed. Other backup drain holes 138 (FIG. 10) may also be placed along various locations of the sidewall 119. The upper base portion 110 of the drain pan 100 channels water to the trough portion 120. As shown in FIGS. 3-5, risers or cones 140 may be integrally formed within the trough portion 120 in order to support an equipment unit 30 in the standard, substantially flat position. Risers 140 may be short or tall, and they may hold the equipment unit 30 level or at a slight angle in order to facilitate drainage from the primary pan (not shown) within the equipment unit 40.

FIGS. 4 and 5 show the drain pan 100 of FIG. 3 in its flat orientation, as if resting on plywood or a platform. If, for example, the pan in FIG. 3 is 27"×64" in folded position, the same pan in FIG. 4 is 32"×64" flat, with the same 2" height for the sidewalls 119 and a drain hole (not shown) front and center. This one pan 100 covers multiple popular sizes.

FIG. 8 illustrates an alternative configuration in which the drain pan 100 folds along discrete lines or folds or (in the case of plastic) living hinges 170 and corresponding sidewall gussets 171.

Figure 9:
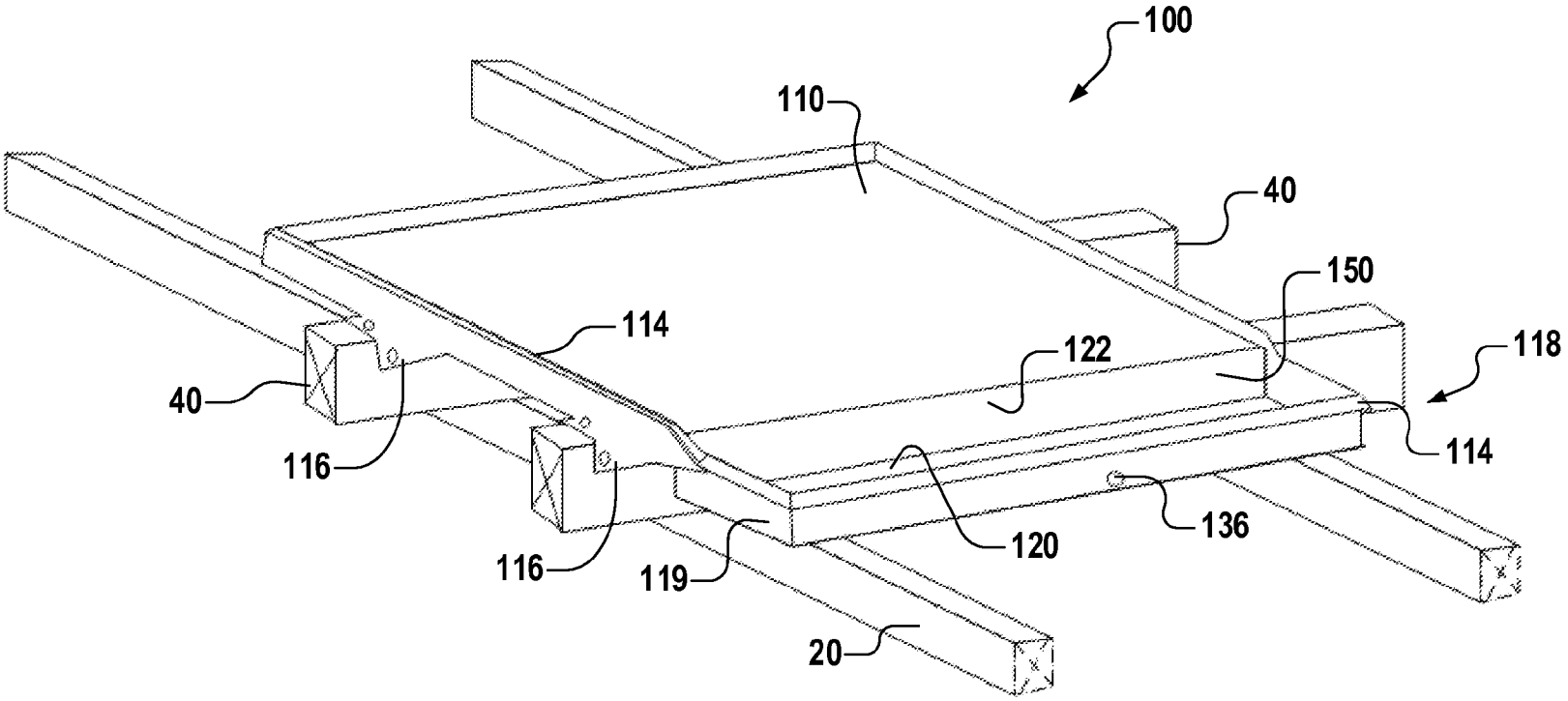
FIG. 9 is a perspective view of a square drop-front drain pan.
Figure 10:
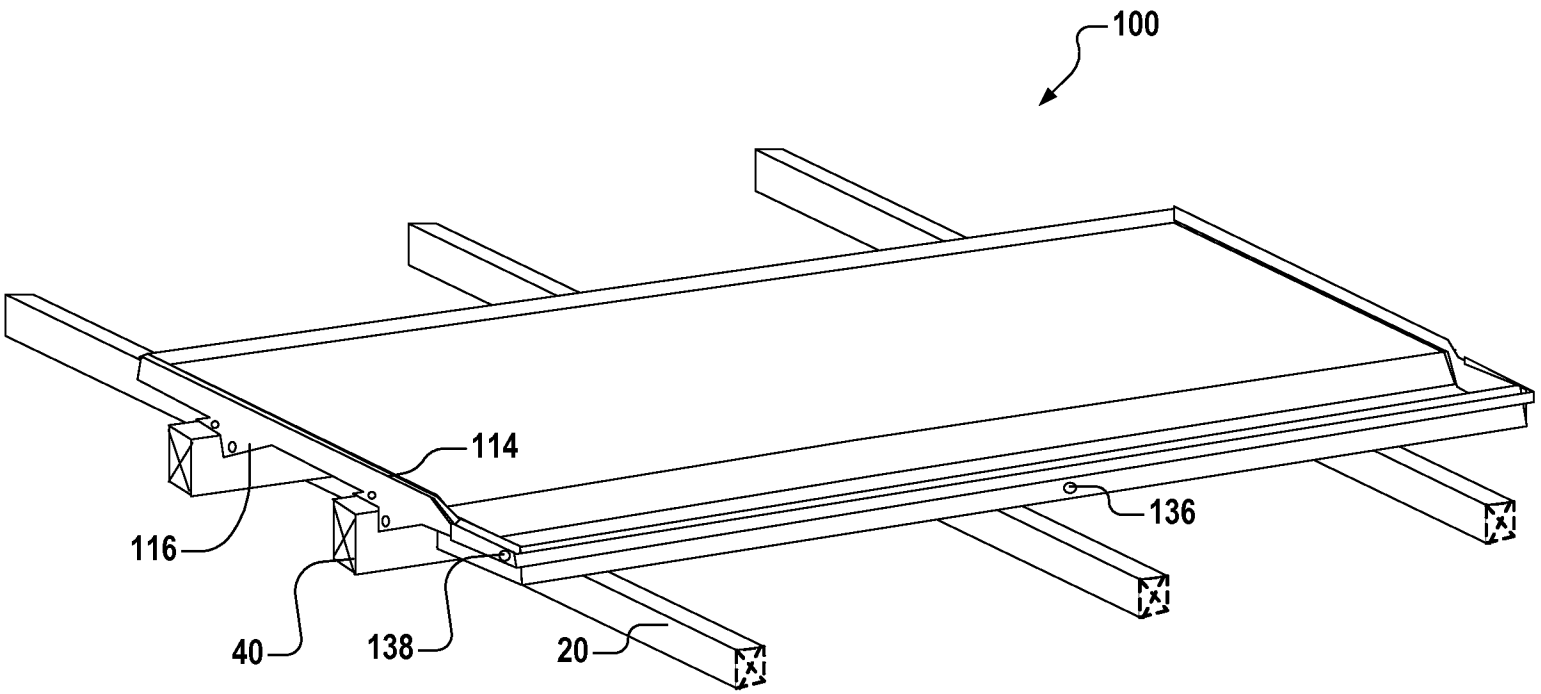
FIG. 10 is a perspective view of a rectangular drop-front drain pan.

FIGS. 9 and 10 show two sizes (24"×24" and 30"×60", respectively) of a drop-front drain pan 100. The pan 100 has a reinforcing lip 114 around the perimeter. The lip 114 includes lip extensions or lugs 116 that turn down, parallel to the sidewalls 119, that form notches or saddles 126 (FIG. 2) over the 2" lumber beams 40. As with many of the other embodiments, this pan 100 may be unibody (integrally formed) and nestably stackable with other pans 100. Such characteristics reduce storage space and minimize manufacturing and material cost.

Figure 11:
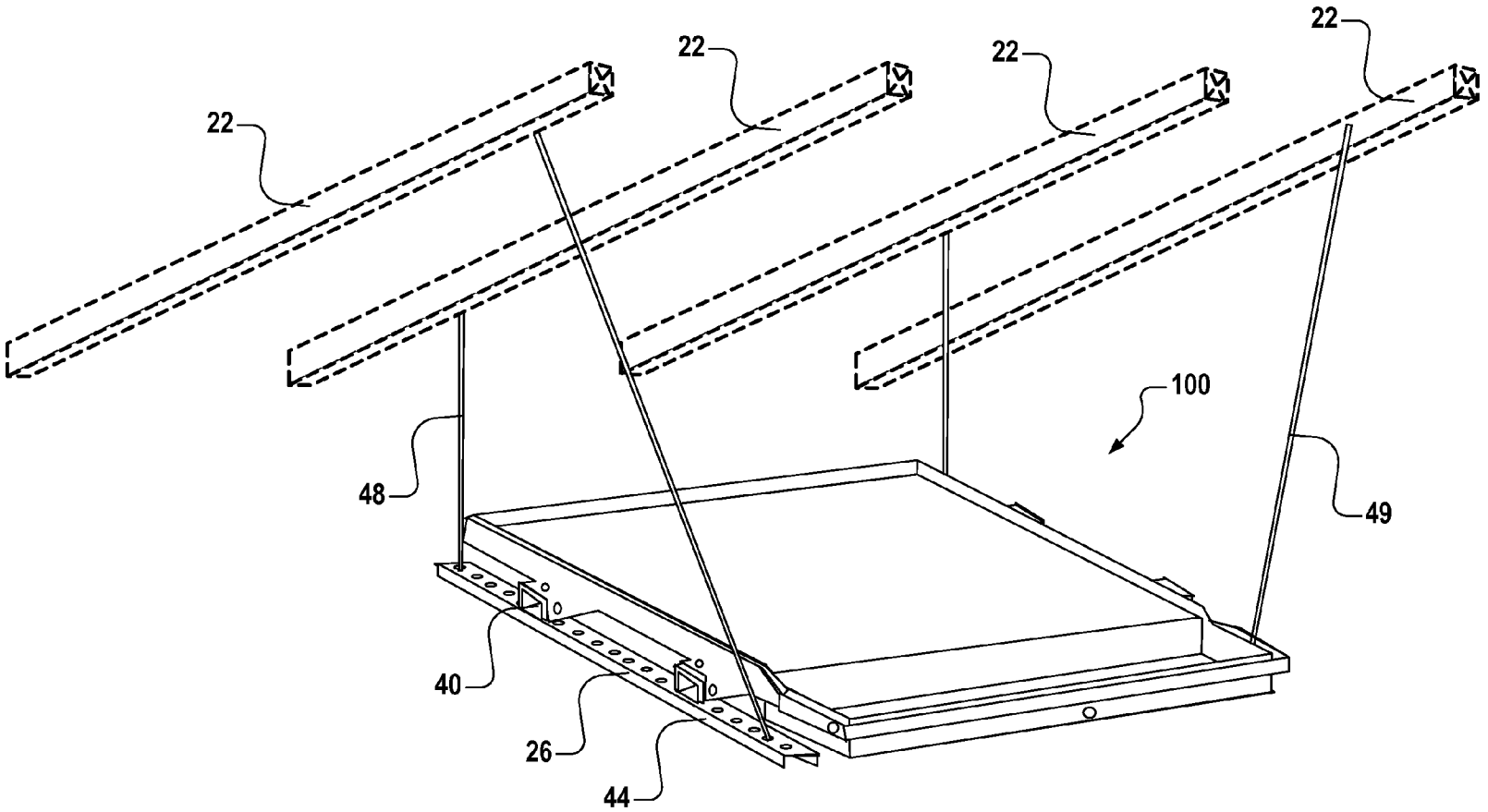
FIG. 11 is a perspective view of a drop front drain pan suspended from rafters.

FIG. 11 illustrates a square drop-front pan 100 hanging from the rafters 22 via threaded rods 48 and 49. Often, a pan will hang from just two rafters 22, but the illustrated configuration spreads the load across four. Other structural supports may replace the threaded rods 48 and 49, such as chains. Although not shown in FIG. 11 for purposes of clarity, the unit 30 itself may be hung from the rods 48 and 49, and any pan 100 suspended underneath, requiring its own support. Alternatively, a piece of plywood 15 may be suspended, with the pan 100 and unit 30 on top. FIG. 11 also illustrates pieces of angle iron or channel strut 44 running from front to back, along the side of the pan, to provide added stability and allow the hanging members 48 and 49 to be attached at the far corners of the pan 100, out of the way of ductwork and panel doors. The pan 100 may also be hung using 2" lumber or another rigid material instead of strut 44.

Figure 12:
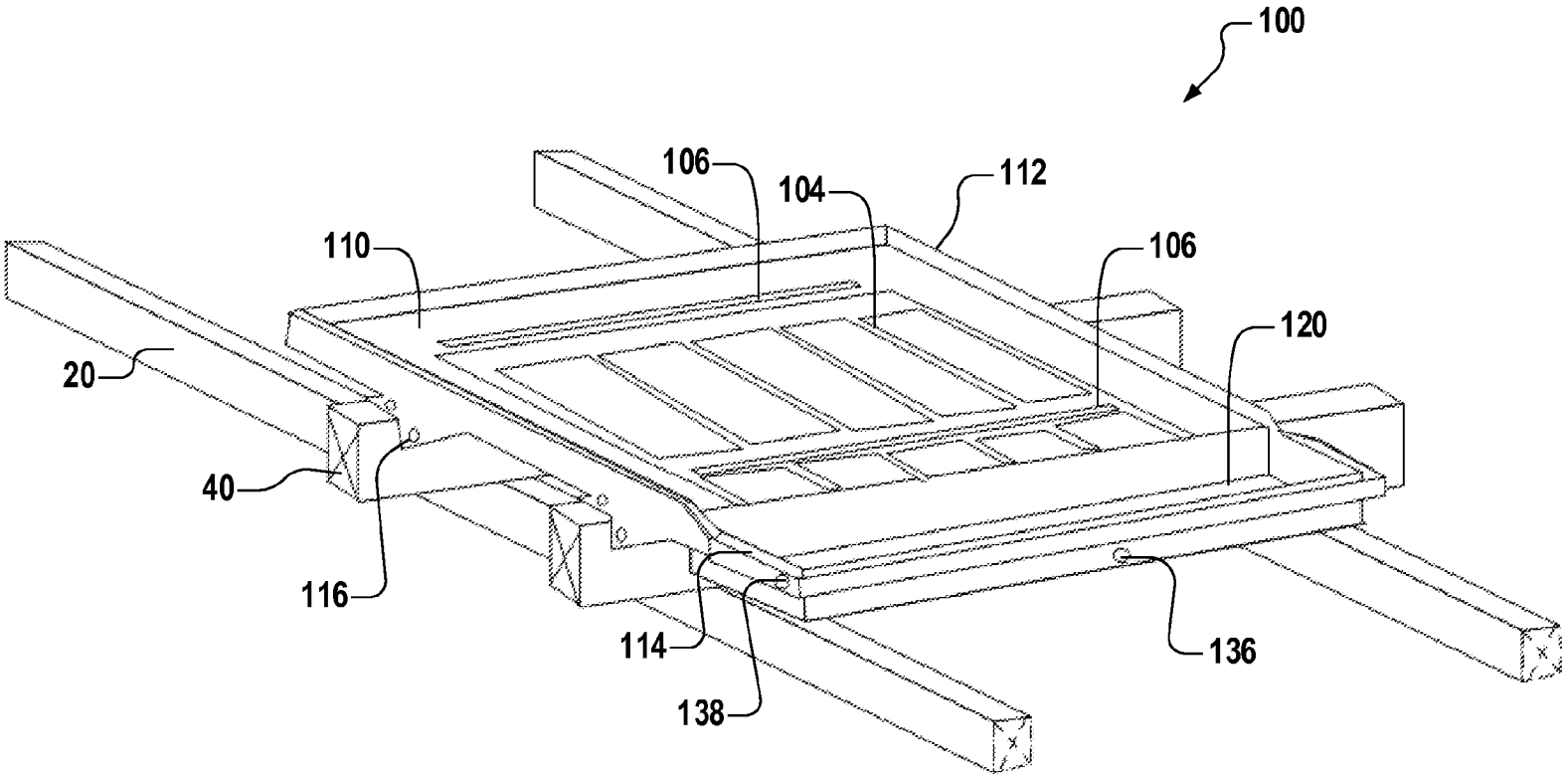
FIG. 12 is a perspective view of drainage channels formed in the bottom surface of the drop-front drain pan.

FIG. 12 shows the same square drop-front pan 100 with small channels 104 in the pan bottom to facilitate placement of anti-vibration pads and channel water to the front of the pan 100. Also shown are ribs or ridges 106, or raised areas of the pan bottom, to elevate the unit 30 slightly out of the water if no anti-vibration pads are employed. These channels 104 also form profiles that give the pan 100 added rigidity.

Figure 14:
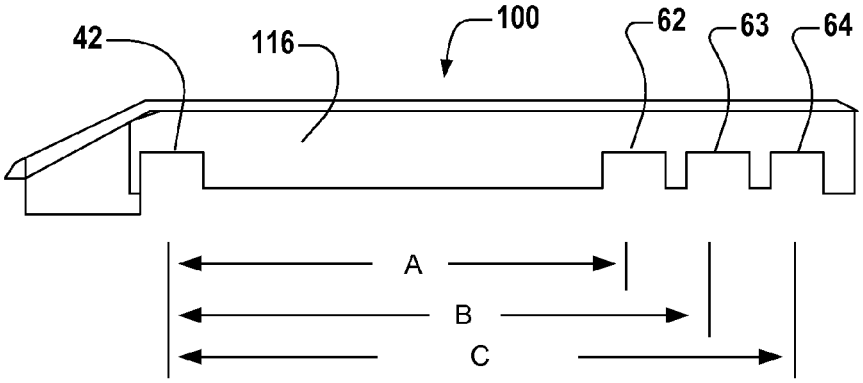
FIG. 14 is a side view of a drop-front drain pan with multiple notches for side-to-side support beams.

FIG. 14 illustrates a right side view of a pan 100 with multiple "saddles" or notches formed by downwardly extending projections or lugs in an extended, down-turned lip 116 to give the contractor more options for installation. Contractors are accustomed to 16" and 24" on center spacings, but given the sizes of popular drain pans, the actual spacing between support beams 40 may be closer to 20". Accordingly, the pan 100 includes a first notch 42 adjacent, and formed in part by, the drop front trough portion 120. Second, third, and fourth notches 62, 63, and 64, respectively, are spaced distances A, B, and C away (measured from the notch centers) from notch 42. For example, distances A", B", and C" may be 16", 20", and 24" respectively.

A variety of additional features are contemplated to facilitate installation of the drain pan 100. The drain pan 100 may be anchored, for example, by gravity, straps, lugs, saddles, screws through cones, zip ties, and other mechanisms, to support beams 40, the existing truss chords or framing joists 20, to a plywood surface 15, or to a hanging or cantilevered frame. The weight of the unit 30 on top and the stability of ductwork and piping may also aid in keeping the pan 100 in place.

Figure 16:
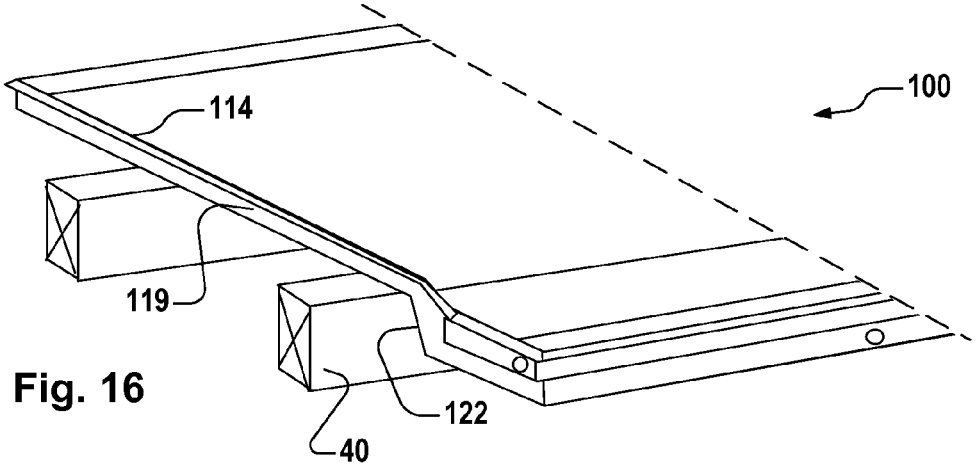
FIGS. 16-18 are perspective views of the side of a drop front drain pan using various structures for mounting or attaching the drop front drain pan to support beams.

FIG. 16 illustrates a pan 100 with a short lip 114 around the perimeter of the sidewalls 119. Here, no direct method of attachment is shown, but the back face 122 of the drop-front trough or lower base section 120 cozies up to the beam 40 in the front. A strap or other method of mechanical attachment may be used in the back to attach the lip 114 to the rear beam 40.

Figure 17:
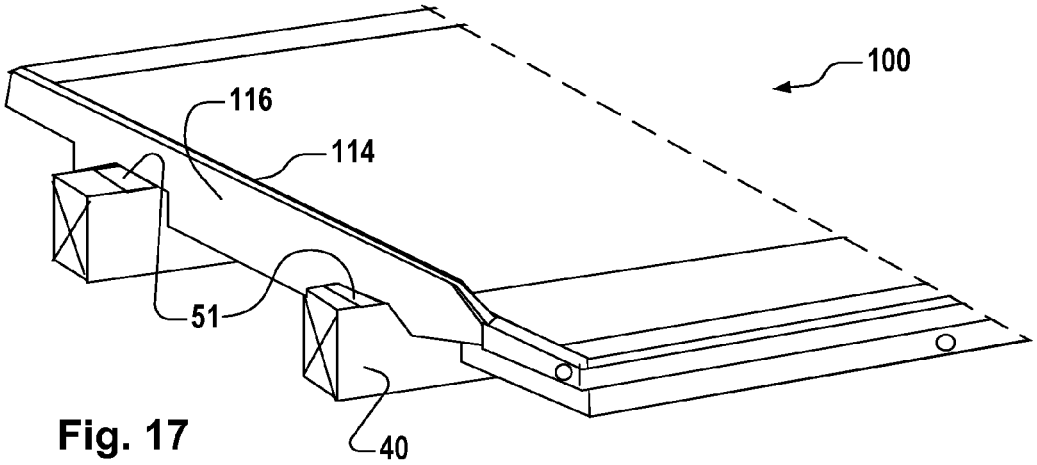

FIG. 17 illustrates 2" beams that pass through the sides of the pan 100 that are attached to the beams 40 via flaps or tabs 51, rather than a saddle, protruding from the side of the pan 100. The flaps 51 may extend directly from the pan side, where the side intersects the bottom. Alternatively, the pan lip 114 may turn down, further than the bottom of the pan 100, such that there is a gap between the pan side and the down-turned lip, and the flaps 51 are formed out of material from the lip extension 116.

Figure 18:
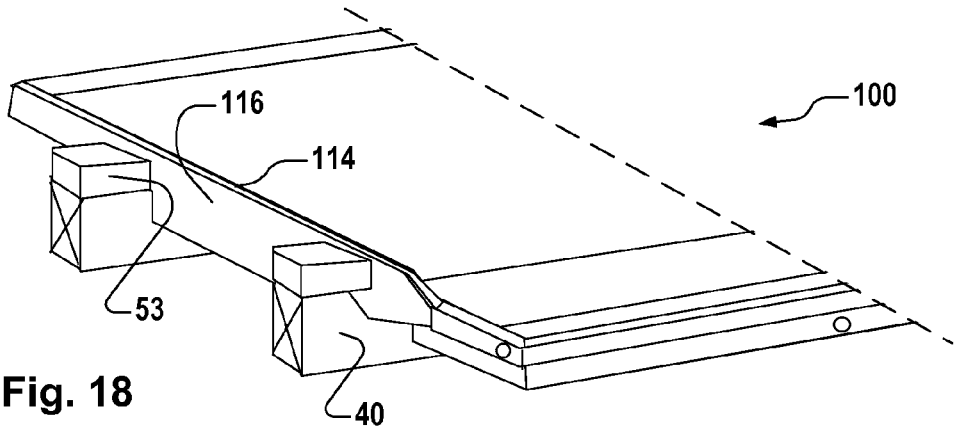

FIG. 18 illustrates blocks 53 (e.g., of wood) that are added to the top of the 2" beams 40 to pin the pan 100 in place.

Figure 19:
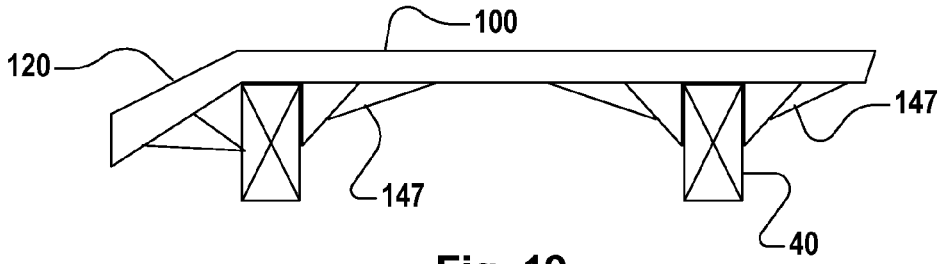
FIGS. 19-20 are side views of a drop front drain pan using various structures for providing additional support to the drop front drain pan to support beams.
Figure 20:
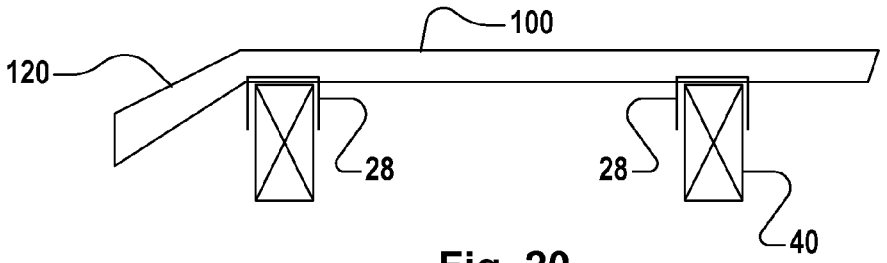

FIGS. 19 and 20 illustrate additional support that can be added around the support beams 40 to secure and/or support the pan 100. FIG. 19 uses ribbing 147, and FIG. 12 uses a u-channel type of clip 28 that may be embedded or added separately. If made of a somewhat flexible material that can be folded during storage, such supports may still allow the pan 100 to be stackable. In either case, the added supports do not affect the ability of the drainage to flow to the front of the pan.

Figure 21:
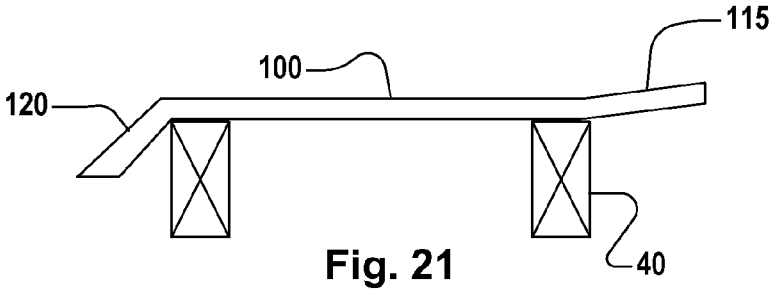
FIG. 21 is a side view of a drop-front drain pan with a sloped back section.
Figure 22:
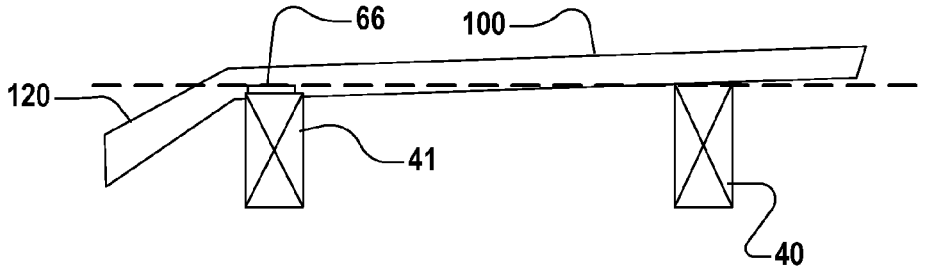
FIG. 22 is a side view of a fully sloped drop-front drain pan.

Flow of drainage is obviously important. FIG. 21 illustrates a pan 100 with an angled back 115 to make sure that water flows to the drop-front trough portion 120. FIG. 22 illustrates a slightly shorter 2" beam 41 in the front, near the drop-front trough portion 120, than the 2" beam 40 in the back, giving the pan 100 a slope. In FIG. 22, risers 66 would be placed inside the pan 100 on top of the front beam 41 in order to level any unit 30 mounted on the pan 100. Even with a substantially flat pan 100, the bottom surface may be formed so that it has a very slight downward slope to the front trough portion 120.

It should be noted that in FIGS. 18-22, many features of the drop front pan 100 have been omitted for simplicity.

Figure 15:
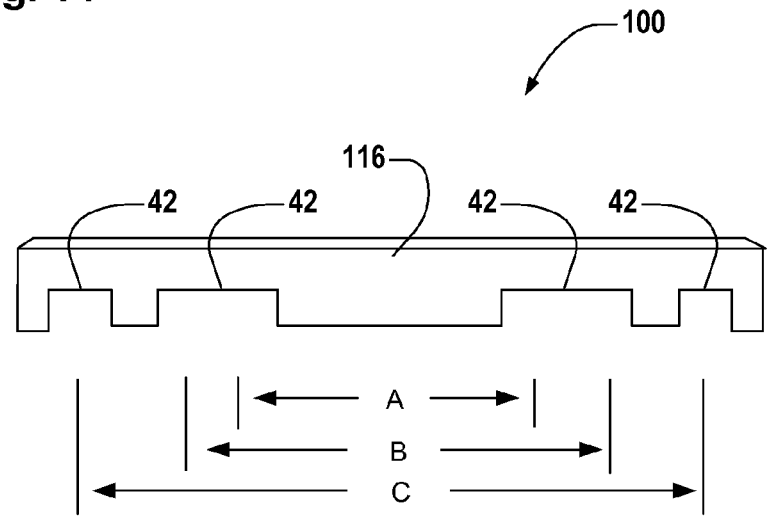
FIG. 15 is a rear view of a drop-front drain pan with multiple notches for front-to-back support beams.

Many of the described embodiments of the pan 100 are configured for, and show, support beams 40 running side to side under the drain pan 100. In some instances, a design may be preferred for support beams 40 that run front to back, as shown, for example, in FIGS. 3-7. FIG. 15 is a rear view of a drain pan 100 with an extended, down-turned lip extension 116 running adjacent the back sidewall. The descending lugs or projections of the lip extension 116 form notches or saddles 42 accepting beams spaced apart distances A, B, and C, which may be 16", 20", and 24" respectively. For simplicity, FIG. 15 does not show the drop-front trough 120 of the pan 100.

FIG. 13 also illustrates a configuration of the pan 100 designed to be mounted over front-to-back support beams. In this configuration, support beam receiving channels also rise above the bottom surface of the upper base portion 110 to form long, front-to-back risers, in the form of raised ribs or ridges 105, for elevating the unit 30. All drainage still flows to the drop-front trough portion 120.

In another embodiment, not shown, support beams 40 would run diagonally beneath the pan 100, and corresponding lugs, notches, saddles, and/or channels would also run, or be disposed, diagonally along the sidewalls 119 and/or underside of the pan 100.

Figure 23:
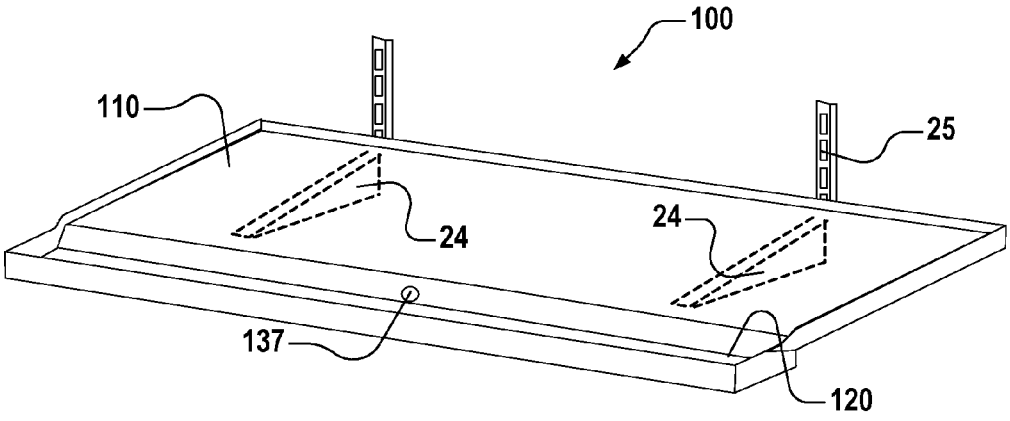
FIGS. 23-24 are perspective views of a drop-front drain pan installed on wall brackets for use with a mini-split installation.

Mini-splits are increasing in popularity, and those that function in heat pump mode may also require drain pans 100. The mini-splits are typically installed on wall brackets 25, with a standard drain pan 10 hanging underneath. FIG. 23 illustrates how installation of the drop-front drain pan 100 would provide a more uniform and attractive look for a mini-split installation. The pan 100 hides the bottom portion of the horizontal supports 24, and a drain hole 137, if needed, would go out the bottom/back of the drop front trough portion 120 of the pan 100.

Figure 24:
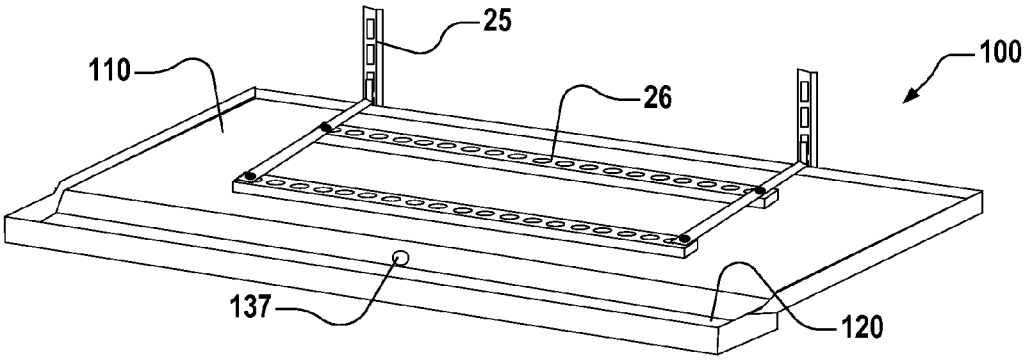

FIG. 24 illustrates an embodiment of a mini-split installation that installs the drop front drain pan 100 over the horizontal supports 24 (not shown), and then installs an additional metal frame 26, attached to the wall brackets 25, on or over the surface of the main base section 110 to support the mini-split unit. The drop-front pan 100 protects the frame 26 from standing water. It will be evident that the drop front drain pan 100 may also be used with traditional window units.

In the embodiment of the expandable drain pan 100 illustrated in FIGS. 25-30, the convertible transition section 150 of the pan 100 is referred to as an expansion section 150. The drain pan 100 comprises a base portion 110 and sidewalls 119 that include at least one expansion section 150. The pan 100 may be expanded or compressed and still lie flat. Contractors in the field will appreciate a pan 100 with an expansion portion 150 that can convert the pan 100 to a range of standard or common drain pan sizes. The expandable and/or bendable properties of the gussets 160 at key points or fold lines allow the pan 100 to transform. Valleys or drainage channels 162 may run across the transition section or fold area 150 to aid drainage. Or, the channels of the gussets 160 may be shallower than illustrated.

It also is envisioned that the pan 100 may fold in ways and locations other than those illustrated, as previously discussed related to FIG. 8. It should be noted that in FIGS. 25-30, many features of the expandable drain pan 100 have been omitted for simplicity.

Figure 25:
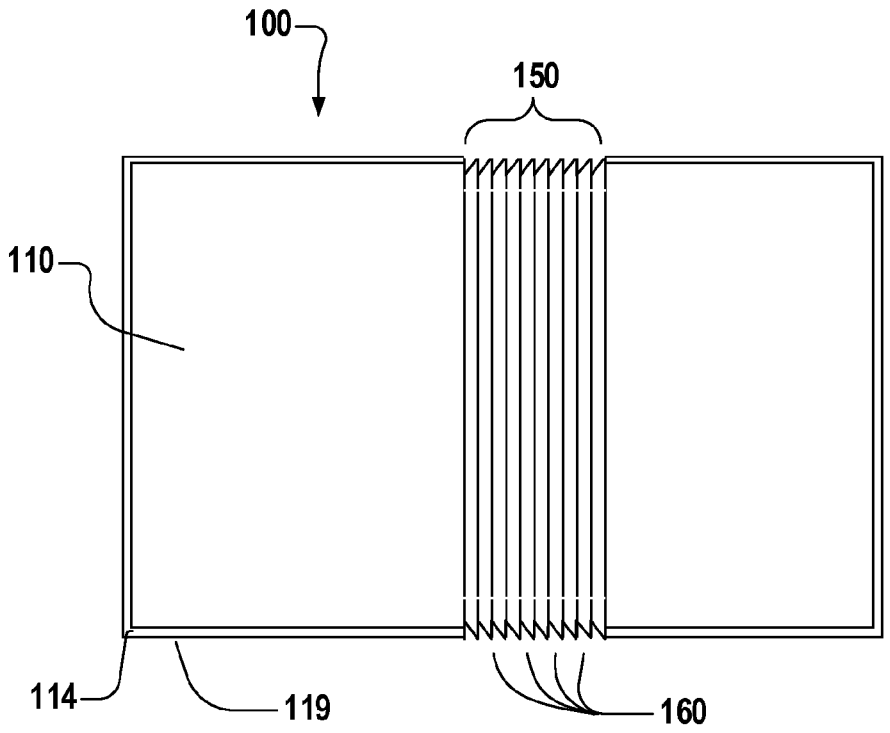
FIG. 25 is a top view of a drain pan with an expansion section.

FIG. 25, a top view of a drain pan 100, illustrates an expansion section 150 located toward the center of the drain pan 100. Condensate that overflows from an air conditioning unit 30 installed above may flow across the expansion section 150 to reach a drain hole 136 (not shown). Additional profiles (not shown) may be added to the base portion 110 and sidewalls 119 of the drain pan 100 to add rigidity. The drain pan 100 may be unibody and nestably stackable. In one embodiment it is thermoformed of plastic, but the product is not limited to plastic or to the process of thermoforming. Risers or cones 140 may be integrally formed within the drain pan 100.

Figure 26:
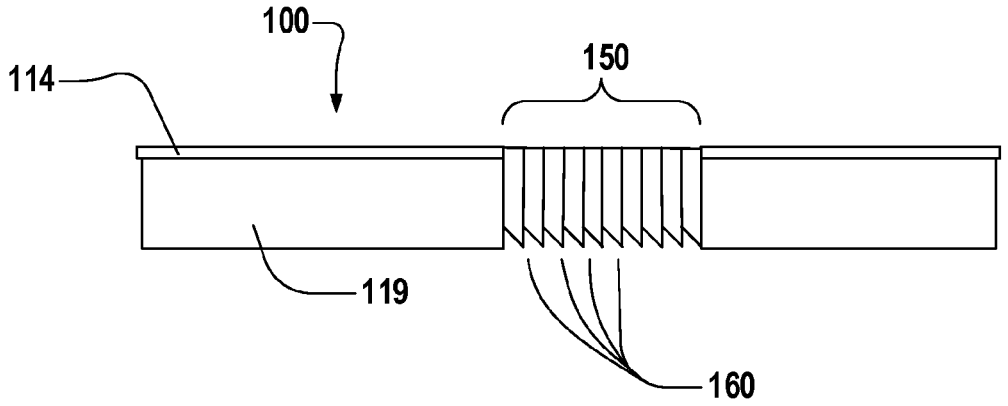
FIG. 26 is a side view of the drain pan of FIG. 25 with an expanded expansion section.

FIG. 26, a side view of the drain pan 100 in FIG. 25, illustrates an expansion section 150 that has been expanded. In this configuration, the gussets 160 have a triangular appearance, but the gussets 160 are preferably rounded as they round the corner from the side walls 119 to the base 100, as shown in FIG. 4. The gussets 160 do not have to be rounded, but rounding is typically better for manufacturing and durability.

Figure 27:
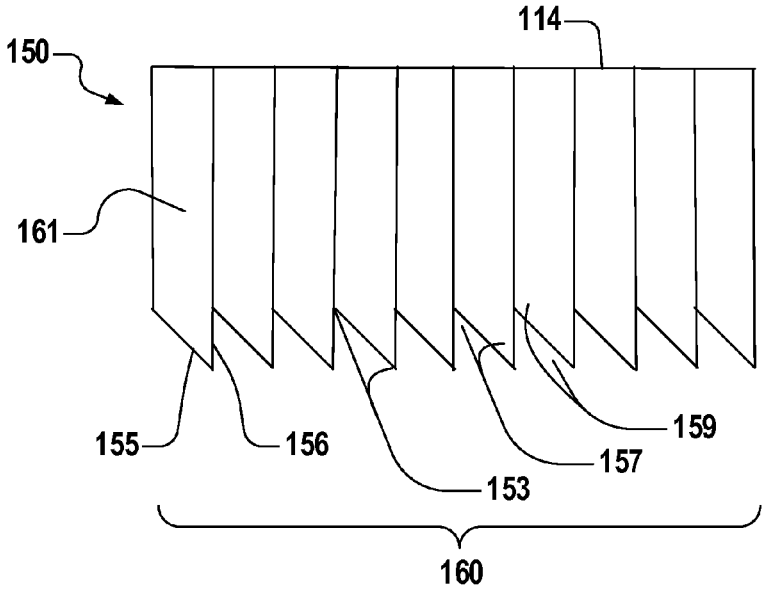
FIG. 27 is a side view of the expansion section of FIG. 26.

FIG. 27, a side view of the expansion section 150 of FIG. 26, better details this configuration. Each gusset 160 forms a semi-conical portion 161 bounded in part by a lower leg 155 and a side leg 156. These legs 155 and 156 connect (around the side walls 119 and base 110 of the expansion section 150) to form joints 153. When the gussets 160 are compressed, the joints 153 allow the semi-conical portions 161 to nest and the drain pan 100 to reduce in size. When the gussets 160 are expanded, the joints 153 allow the drain pan to increase in size according to the leg 155 and 156 lengths. The legs may be configured such that they "lock" after compression or expansion, such that the drain pan 100 maintains its adjusted size. Alternatively, mechanical fasteners or other means may be employed to secure a pan 100 in its adjusted size.

In this configuration, the legs 155 and 156 of the semi-conical portion 161 form a right triangle with a first angle 157 and a second angle 159. The first angle 157 may be 30 degrees and the second angle 159 may be 60 degrees. Or those measurements may be reversed. The angles 157 and 159 are not limited to those degrees, and the triangle is not limited to a right triangle. Rather, different variations on this configuration will allow for variations in expansion and compression.

The lengths of the legs 155 and 156 determine the height of the base 110 of the expansion section 150. Thus the legs 155 and 156 influence the flow of drainage across the expansion section 150. Ideally, the lower the drain hole 136 (not shown) on a side wall 119 (not shown), the lower the height of the base 110 of the expansion section 150 should be, so drainage does not pool away from the drain hole 136. It is expected that a lower leg 155 may be about ½" long in a shallow configuration of this product, but a lower leg 155 is not limited to ½" in length.

Figure 28:
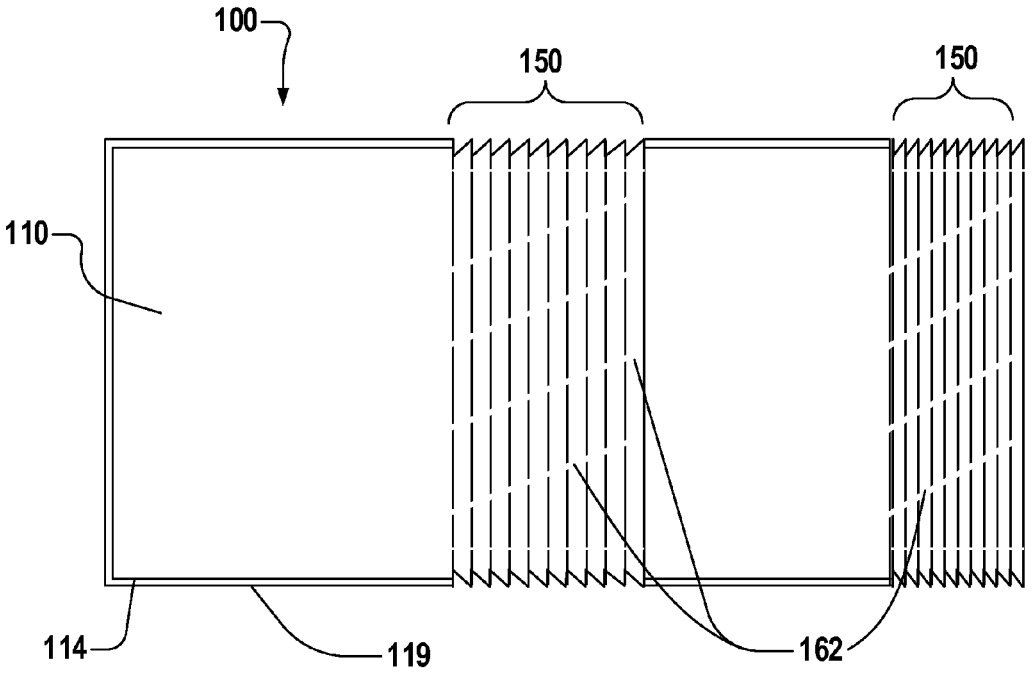
FIG. 28 is a top view of a drain pan with two expansion sections.

FIG. 28 illustrates an expandable drain pan 100 with two expansion sections 150, one located toward the center of the drain pan 100 and the other located along a side of the drain pan 100. In this illustration, the central expansion section 150 is shown in a fully expanded configuration. One or both expansion sections 150 may be compressed or expanded for storage and for installation. Additionally, the sidewalls 119 of the expansion sections may or may not have lips. Both expansion sections 150 contain drainage valleys or channels 162 to reduce pooling and help drainage cross the expansion section 150.

Figure 29:
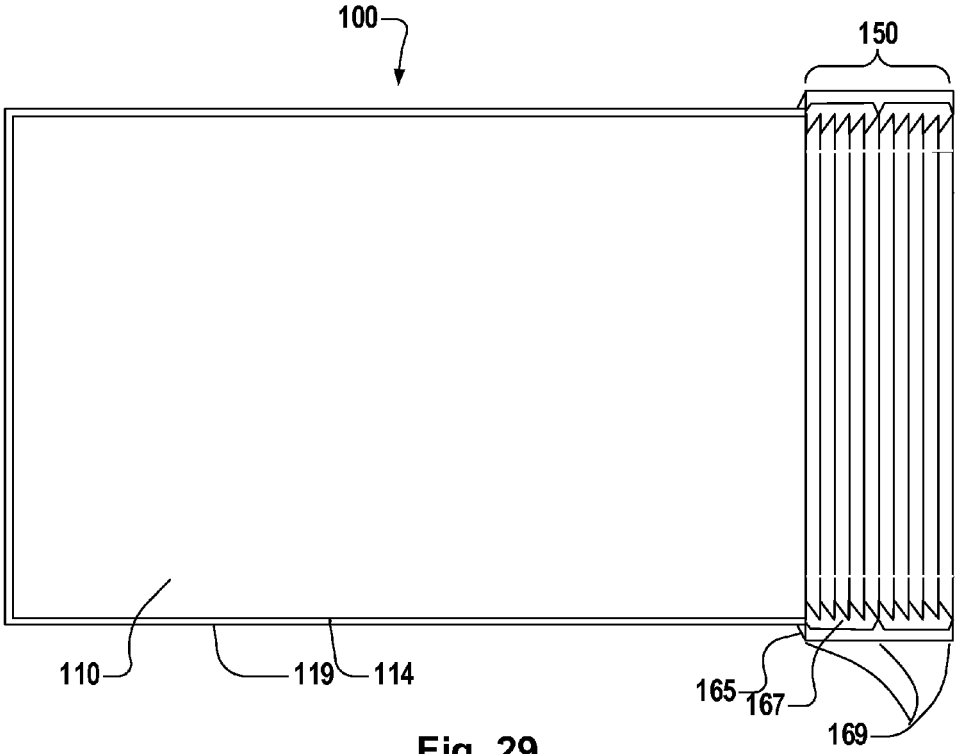
FIG. 29 is a top view of a drain pan with an expansion section along a side.

FIG. 29 illustrates an expandable drain pan 100 with an expansion section 150 along a side. In this configuration the expansion section lip 165 runs the length of the expansion section 150 along the sidewall 119 and is connected to the expansion section by tabs 169. If the drain pan 100 is thermoformed, then a space 167 is created between the expansion section 150 and the expansion section lip 165 by use of a router or water jet, leaving the tabs 169. In practice, an installer would cut the expansion section lip 165 and and/or tabs 169 before compressing or expanding part or all of the expansion section 150. The installer may use standard sheet metal screws through the cut parts of the expansion section lip 165 to secure the compressed or expanded pan 100 to itself or to a supporting structure in order to help the drain pan 100 maintain its adjusted size. The drawing shows three tabs 169 on each side, but the drain pan 100 is not limited to three tabs 169 per side. The drain pan 100 may utilize no tabs 169 or may omit expansion section lip 165. Further, the expansion section lip 165 itself may be flexible and expandable.

An expansion section 150 is not limited to a specific expansion length. However, for example, if the drain pan 100 in FIG. 29 is 32"×63" in its original position, the pan 100 may compress to 30"×63" or 27"×63" or expand to 36"×63". An expansion section 150 with approximately 6" extension length would cover multiple adjusted sizes and allow anti-vibration pads or risers to contact both the base 110 and the equipment 30 without interference from the expansion section 150 itself. Therefore, the installer receives greater functionality from one drain pan.

Figure 30:
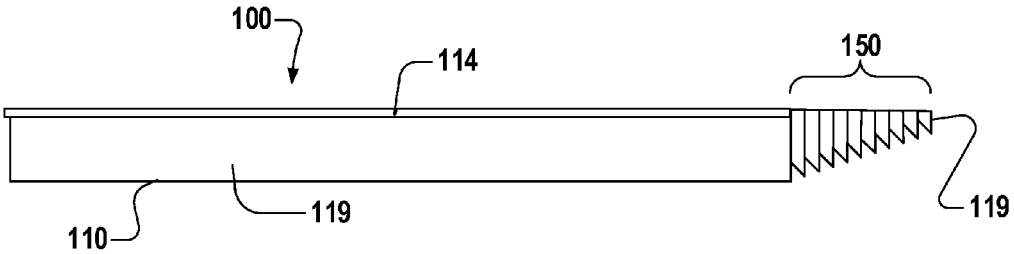
FIG. 30 is a side view of a drain pan with a stepped expansion section along a side.

FIG. 30 illustrates a drain pan 100 with a stepped expansion section 150 along a side. The base 110 of the expansion section 150 may be stepped such that the base 110 at a side of the pan 100 is higher than the base 110 toward the center of the pan 100, allowing drainage to cascade toward the center of the pan 100 and away from a side 119 of the pan 100. The gussets 160 may be secured to maintain the pan 100 in this position. As in FIG. 27, the gussets or folds 160 comprise angles that allow the folds to compress, expand, and "lock" like the corrugations of a flexible drinking straw or downspout. Unlike those products, which flex somewhat like a ball joint, the drain pan 100 is not circular and has an open top, reducing flexibility. Thus, the expansion section 150 mainly expands and collapses in a unidirectional manner, such that a sidewall 119 whether expanded or collapsed resides in the same relative orientation. Additionally, thermoforming a product of this thickness with such flexibility is a technical challenge. The top of the transition portion 150 may have no upper lip 114 in order to increase flexibility. The fold lines of the configuration section 150 may be configured other than as shown, and other methods may be used to make the drain pan 100 maintain its adjusted size.

Secondary drain pans 100 are required by code to be larger on each side than the equipment 30 resting above, and risers or other supports placed in the pan 100 under the equipment 30 are typically located several inches inside the perimeter of the equipment. For this reason, the stepped expansion section 150 along a side of a pan 100 will not interfere with the air conditioning unit 30, and drainage is less likely to drip into the expansion section 150 along the side than into the central area of the base 110.

A method for installing a pre-manufactured expandable secondary condensate drain pan 100 under an air conditioning unit 30 comprises adjusting the size of the drain pan 100, configuring the drain pan 100 to remain as adjusted, placing the drain pan 100 on a support, installing a set of anti-vibration pads 61 or risers 59, and setting an air conditioning unit 30 on the drain pan 100. The method may further comprise cutting one or more expansion section lips 165. Some steps in this method may be reordered or omitted.

Although the foregoing specific details describe various embodiments of the invention, persons reasonably skilled in the art will recognize that various changes may be made in the details of the apparatus of this invention without departing from the spirit and scope of the invention as defined in the appended claims.

The present invention includes several independently meritorious inventive aspects and advantages. Unless compelled by the claim language itself, the claims should not be construed to be limited to any particular set of drawings, as it is contemplated that each of the drawings may incorporate features shown in others of the drawings.

I claim:

1. A secondary condensate drain pan for installation under an air handling unit, the secondary drain pan comprising:

a base;

a continuous sidewall around a perimeter of the secondary drain pan extending upwardly from the base to form a continuous basin; and an expansion section within the basin comprising a plurality of upper fold lines and a plurality of lower fold lines, the expansion section configured to expand and collapse along the pluralities of upper and lower fold lines;

wherein the expansion section includes portions of the base and portions of the continuous sidewall;

wherein the secondary condensate drain pan is configured to capture condensate that overflows from a primary drain pan of the air handling unit that is mounted above the secondary drain pan;

wherein, whether the expansion section is expanded or collapsed, the continuous sidewall is high enough, relative to the upper fold lines of the expansion section, to enable condensate to flow across the upper fold lines while remaining contained within the basin; and wherein the continuous basin comprises a drainage outlet, and the expansion section is configured to minimize pooling of drainage away from the drainage outlet as the basin provides a pathway for condensate to the drainage outlet.

2. The secondary drain pan of claim 1, wherein the secondary drain pan is contoured so that its sidewall flares outwardly so that the secondary drain pan is nestably stackable with another secondary drain pan.

3. The secondary drain pan of claim 1, wherein the expansion section is configured, after adjustment to an adjusted size, to retain its adjusted size when placed under the air handling unit.

4. The secondary drain pan of claim 1, wherein the sidewall is configured to expand unidirectionally as the expansion section expands and to collapse unidirectionally as the expansion section collapses.

5. The secondary drain pan of claim 1, further comprising a coating on the expansion section to prevent leakage.

6. The secondary drain pan of claim 1, wherein the expansion section is gusseted and flexible.

7. The secondary drain pan of claim 1, wherein the base includes a non-expansion section adjoining the expansion section.

8. The secondary drain pan of claim 1, further comprising integrally formed risers that extend upwardly from the base to provide a raised support surface capable of supporting the air handling unit.

9. A secondary condensate drain pan for installation under an air handling unit, the secondary drain pan comprising:

a base;

integrally formed risers that extend upwardly from the base to provide a raised support surface capable of supporting the air handling unit;

sidewalls around a perimeter of the secondary drain pan extending upwardly from the base to form a basin; and an expansion section configured to expand and collapse along a plurality of fold lines;

wherein the expansion section includes portions of the base and portions of at least two sidewalls;

wherein the secondary condensate drain pan is configured to capture condensate that overflows from a primary drain pan of the air handling unit that is mounted above the secondary drain pan; and wherein, whether the expansion section is expanded or collapsed, the sidewalls are high enough, relative to the fold lines of the expansion section, to enable condensate to flow across the fold lines while remaining contained within the basin.

10. The secondary drain pan of claim 9, wherein one of the sidewalls comprises a drainage outlet, and the expansion section is configured to minimize pooling of drainage away from the drainage outlet.

11. The secondary drain pan of claim 9, wherein the expansion section is configured, after adjustment to an adjusted size, to retain its adjusted size when placed under the air handling unit.

12. The secondary drain pan of claim 9, wherein the expansion section extends from a side of the secondary drain pan.

13. The secondary drain pan of claim 9, wherein the secondary drain pan comprises at least two expansion sections separated by a non-expandable section of base.

14. The secondary drain pan of claim 9, further comprising a coating on the expansion section to prevent leakage.

15. The secondary drain pan of claim 9, wherein the secondary drain pan is contoured so that its sidewalls flare outwardly so that the secondary drain pan is nestably stackable with another secondary drain pan.

16. The secondary drain pan of claim 9, wherein the sidewalls are configured to expand unidirectionally as the expansion section expands and to collapse unidirectionally as the expansion section collapses.

17. The secondary drain pan of claim 9, wherein the base includes a non-expansion section adjoining the expansion section.

18. A secondary condensate drain pan for installation under an air conditioning unit, the secondary drain pan comprising:

a base;

sidewalls around a perimeter of the secondary drain pan extending upwardly from the base to form a basin; and at least one expandable section configured to expand and compress along a plurality of fold lines, the expandable section extending from a side of the secondary drain pan;

wherein the expandable section is configurable to extend the secondary drain pan from a compressed configuration to an expanded configuration;

wherein the secondary condensate drain pan is configured to capture condensate that overflows from a primary drain pan of the air conditioning unit that is mounted above the secondary drain pan;

wherein the expandable section is stepped, such that the base at the side of the secondary pan is higher than the base toward a center of the secondary pan, allowing drainage to cascade away from the side of the secondary pan and toward the center of the secondary pan; and wherein, whether the expandable section is expanded or compressed, the sidewalls and the at least one expandable section are configured to enable condensate to flow across the at least one expandable section while remaining contained within the basin.

19. The secondary drain pan of claim 18, wherein the plurality of fold lines further comprises valleys that run across the fold lines for conveying drainage.

20. The secondary drain pan of claim 18, further comprising a coating on the expandable section to prevent leakage.

* * * * *